US010508650B2

(12) United States Patent
Zielberg et al.

(10) Patent No.: US 10,508,650 B2
(45) Date of Patent: Dec. 17, 2019

(54) COOLANT PUMP FOR AN INTERNAL COMBUSTION ENGINE

(71) Applicant: PIERBURG GMBH, Neuss (DE)

(72) Inventors: Stephan Zielberg, Bochum (DE); Andreas Burger, Krefeld (DE); Michael-Thomas Benra, Castrop-Rauxel (DE); Stefan Rothgang, Rheinberg (DE); Michael Becker, Korschenbroich (DE)

(73) Assignee: PIERBURG GMBH, Neuss (DE)

( * ) Notice: Subject to any disclaimer, the term of this patent is extended or adjusted under 35 U.S.C. 154(b) by 92 days.

(21) Appl. No.: 15/772,817

(22) PCT Filed: Oct. 19, 2016

(86) PCT No.: PCT/EP2016/075076
§ 371 (c)(1),
(2) Date: May 2, 2018

(87) PCT Pub. No.: WO2017/076645
PCT Pub. Date: May 11, 2017

(65) Prior Publication Data

US 2018/0320695 A1 Nov. 8, 2018

(30) Foreign Application Priority Data

Nov. 6, 2015 (DE) ..... 10 2015 119 097

(51) Int. Cl.
*F04D 15/00* (2006.01)
*F04D 5/00* (2006.01)
(Continued)

(52) U.S. Cl.
CPC ..... *F04D 15/0038* (2013.01); *F01P 5/10* (2013.01); *F04D 5/002* (2013.01); *F04D 13/12* (2013.01);
(Continued)

(58) Field of Classification Search
CPC .... F04D 15/00; F04D 15/0038; F04D 15/002; F04D 13/12; F04D 13/14; F04D 27/00;
(Continued)

(56) References Cited

U.S. PATENT DOCUMENTS 3,364,860 A * 1/1968 Schmitt-Matzen ..... A47L 15/4225 415/61
5,281,088 A 1/1994 Brandt
(Continued)

FOREIGN PATENT DOCUMENTS

CN 1311389 A 9/2001
CN 101749249 A 6/2010
(Continued)

*Primary Examiner* — Dwayne J White
*Assistant Examiner* — Danielle M. Christensen
(74) *Attorney, Agent, or Firm* — Norman B. Thot

(57) ABSTRACT

A coolant pump for an internal combustion engine includes a delivery duct, a drive shaft, a coolant pump impeller arranged on the drive shaft to covey a coolant into the delivery duct, a control slide which controls a cross-section of an annular gap arranged between an outlet of the coolant pump impeller and the delivery duct, a side channel pump with a side channel pump impeller arranged on the drive shaft and a side channel, a pressure duct comprising a cross-section which fluidically connects an outlet of the side channel to a first pressure chamber of the control slide, a valve which opens and closes the cross-section of the pressure duct, and a first housing part arranged to have the side channel be formed therein and the control slide slidingly guided thereon. The coolant pump impeller is integrally formed with the side channel pump impeller.

11 Claims, 2 Drawing Sheets

(51) Int. Cl.

| | |
|---|---|
| ***F04D 13/12*** | (2006.01) |
| ***F01P 5/10*** | (2006.01) |
| *F01P 3/00* | (2006.01) |

(52) U.S. Cl.
CPC ... *F01P 2003/001* (2013.01); *F01P 2005/105* (2013.01); *F05D 2270/64* (2013.01)

(58) Field of Classification Search
CPC .. F04D 27/002; F04D 27/003; F04D 27/0246; F04D 27/0253; F04D 29/185; F04D 29/22; F04D 29/2211; F04D 29/2238; F04D 29/25; F05D 2270/64; F01P 5/10; F01P 2003/001; F01P 2005/103
See application file for complete search history.

(56) References Cited

U.S. PATENT DOCUMENTS

| | | | | |
|---|---|---|---|---|
| 2010/0143109 | A1* | 6/2010 | Hartman | F04D 1/006 415/204 |
| 2013/0333863 | A1 | 12/2013 | Pawellek | |
| 2014/0050562 | A1 | 2/2014 | Welte et al. | |

FOREIGN PATENT DOCUMENTS

| | | | |
|---|---|---|---|
| CN | 103459798 | A | 12/2013 |
| CN | 203516133 | U | 4/2014 |
| DE | 15 28 718 | B2 | 3/1976 |
| DE | 43 18 158 | A1 | 2/1994 |
| DE | 692 23 216 | T2 | 3/1998 |
| DE | 10 2011 012 826 | B3 | 1/2012 |
| DE | 10 2010 044 167 | A1 | 5/2012 |
| DE | 10 2012 207 387 | A1 | 1/2013 |
| DE | 10 2013 011 209 | B3 | 1/2014 |
| DE | 10 2012 214 503 | A1 | 2/2014 |
| DE | 10 2013 111 939 | B3 | 10/2014 |
| EP | 2 455 615 | A2 | 5/2012 |
| JP | 51-119604 | | 9/1976 |
| WO | WO 2012/116676 | A1 | 9/2012 |
| WO | WO 2015/062752 | A1 | 5/2015 |
| WO | WO 2016/034159 | A1 | 3/2016 |

* cited by examiner

COOLANT PUMP FOR AN INTERNAL COMBUSTION ENGINE

CROSS REFERENCE TO PRIOR APPLICATIONS

This application is a U.S. National Phase application under 35 U.S.C. § 371 of International Application No. PCT/EP2016/075076, filed on Oct. 19, 2016 and which claims benefit to German Patent Application No. 10 2015 119 097.4, filed on Nov. 6, 2015. The International Application was published in German on May 11, 2017 as WO 2017/076645 A1 under PCT Article 21(2).

FIELD

The present invention relates to a coolant pump for an internal combustion engine having a drive shaft, a coolant pump impeller which is arranged at the drive shaft at least in a rotationally fixed manner and via which coolant is adapted to be delivered into a delivery duct surrounding the coolant pump impeller, an adjustable control slide via which a throughflow cross-section of an annular gap between an outlet of the coolant pump impeller and the delivery duct is adapted to be controlled, a side channel pump having a side channel pump impeller which is arranged at the drive shaft at least in a rotationally fixed manner, a side channel of the side channel pump in which a pressure is adapted be generated as a result of rotation of the side channel pump impeller, a pressure duct via which an outlet of the side channel is adapted to be fluidically connected to a first pressure chamber of the control slide, and a valve via which a throughflow cross-section of the pressure duct is adapted be closed and opened.

BACKGROUND

Such coolant pumps serve to control a flow rate of the delivered coolant in an internal combustion engine to prevent the overheating thereof. These pumps are usually driven via a belt or chain drive so that the coolant pump impeller is driven at the speed of the crankshaft or at a fixed ratio to the speed of the crankshaft.

In modern internal combustion engines, the delivered coolant flow must be matched with the coolant demand of the internal combustion engine or the motor vehicle. The cold running phase of the engine should in particular be reduced to prevent increased pollutant emissions and to reduce fuel consumption. This is realized, inter alia, by restricting or completely switching off the coolant flow during this phase.

Various pump designs for controlling coolant flow rate are known. Besides electrically driven coolant pumps, pumps are known which can be coupled to or decoupled from their drive units via couplings, in particular hydrodynamic couplings. A particularly inexpensive and simple manner of controlling the delivered coolant flow is the use of an axially movable control slide which is pushed across the coolant pump impeller so that, for reducing the coolant flow, the pump does not deliver into the surrounding delivery duct, but against the closed slide.

The control of this slide is also performed in different ways. Besides a purely electric adjustment, a hydraulic adjustment of the slides has proved particularly successful. A hydraulic displacement is in most cases carried out via an annular piston chamber which is filled with a hydraulic fluid and whose piston is connected to the slide so that the slide is moved across the impeller during a filling of the chamber. The slide is returned by opening the piston chamber towards an outlet, in most cases via a magnetic valve as well as via a spring action providing the force for returning the slide.

In order for the coolant flow required to move the slide not to be supplied via additional delivery units, such as additional piston/cylinder units, or for other hydraulic fluids not to be compressed for operating purposes, mechanically controllable coolant pumps are known on whose drive shaft a second delivery wheel is arranged via which the pressure for adjusting the slide is provided. These pumps are, for example, designed as side channel pumps or servo pumps.

A coolant system having a side channel pump acting as a secondary pump is described in DE 10 2012 207 387 A1. A slide is here located on the rear side of the pump, which slide is movable via a pressure in a ring chamber and which can be returned by a spring. The ring chamber is formed in a housing which is disposed on the rear side of the slide and in which a first side channel of the side channel pump is arranged that is accordingly disposed opposite to the side channel pump impeller arranged on the shaft. A second side channel is formed in another housing part on the side opposite to the side channel pump impeller. Via a 3/2-way valve in this pump, in a first position, a discharge side of the side channel pump is closed and a suction side of the pump is connected to the coolant circuit and the slide, and, in a second position, the discharge side is connected to the ring chamber of the slide and the suction side is connected to the coolant circuit. A detailed duct and flow routing is not described. In modern internal combustion engines, the schematically shown flow routing for this pump can only be realized with an increased technical effort. This also involves an increased assembly effort and, above all, a larger installation space for the schematically shown flow routing and due to the selected arrangements and the split design of the housing so that such a pump cannot be arranged and installed in a corresponding arrangement of a cylinder crankcase.

SUMMARY

An aspect of the present invention is to provide a coolant pump for an internal combustion engine where the assembly effort and the required installation space are considerably reduced. An aspect of the present invention is in particular to reduce the overall axial length and, if possible, to require no additional installation of lines so that installation as a plug pump in a corresponding axially short recess of a crankcase can be provided.

In an embodiment, the present invention provides a coolant pump for an internal combustion engine which includes a delivery duct, a drive shaft, a coolant pump impeller arranged on the drive shaft so as to rotate jointly therewith, the coolant pump impeller being configured to covey a coolant into the delivery duct which surrounds the coolant pump impeller, a control slide which is configured to be adjustable so as to control a throughflow cross-section of an annular gap arranged between an outlet of the coolant pump impeller and the delivery duct, the control slide comprising a first pressure chamber, a side channel pump comprising a side channel pump impeller arranged on the drive shaft so as to rotate jointly therewith and a side channel which is configured so that a pressure can be generated by a rotation of the side channel pump impeller, the side channel comprising an outlet, a pressure duct comprising a throughflow cross-section, the pressure duct being configured to fluidically connect the outlet of the side channel to the first pressure chamber of the control slide, a valve configured to open and to close the throughflow cross-section of the pressure duct, and a first housing part configured to have the side channel be formed therein and to have the control slide be slidingly guided thereon. The coolant pump impeller is integrally formed with the side channel pump impeller.

BRIEF DESCRIPTION OF THE DRAWINGS

The present invention is described in greater detail below on the basis of embodiments and of the drawings in which.

DETAILED DESCRIPTION

Figure 1:
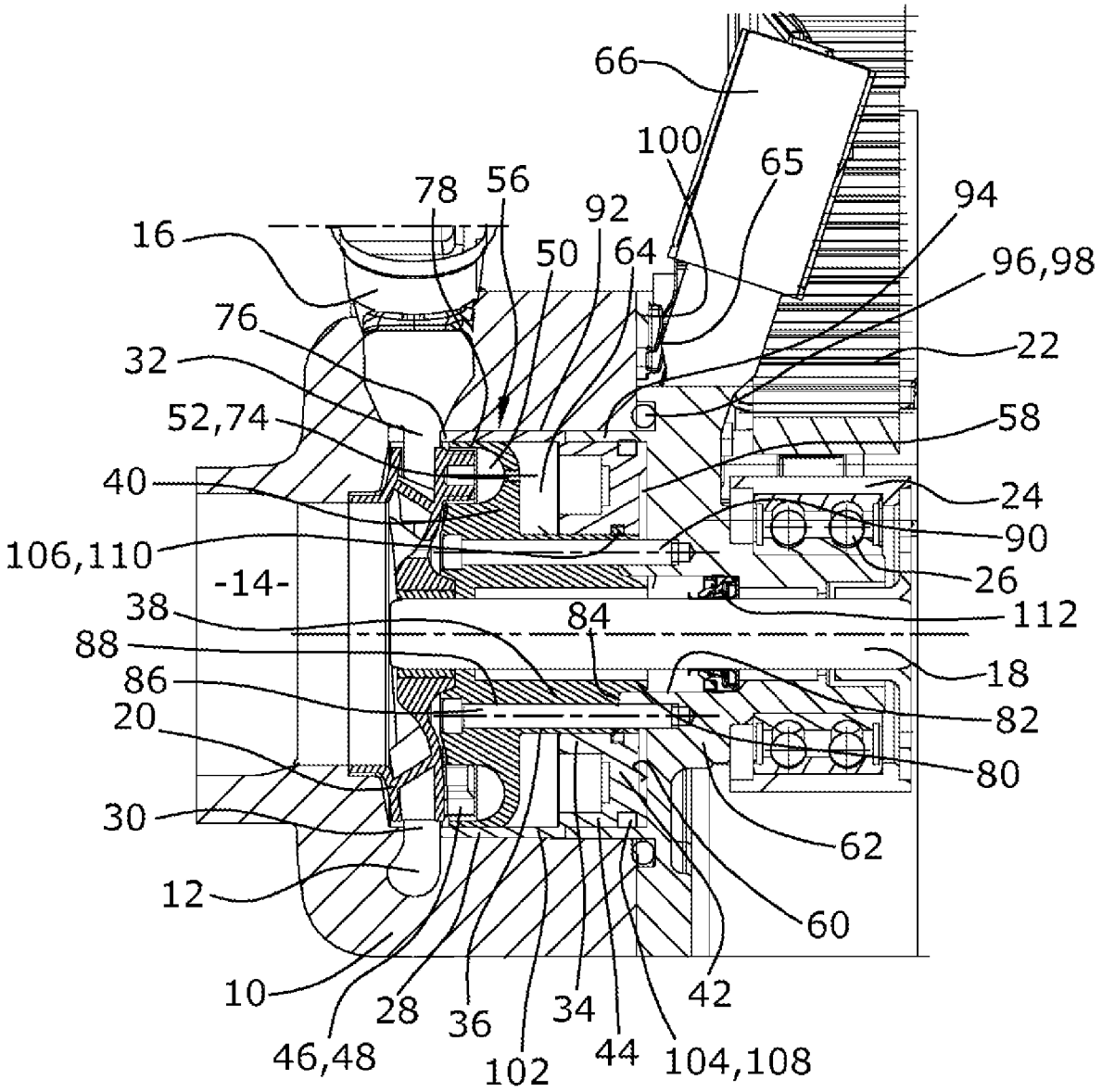
FIG. 1 shows a cross-sectional side view of a coolant pump according to the present invention.
Figure 2:
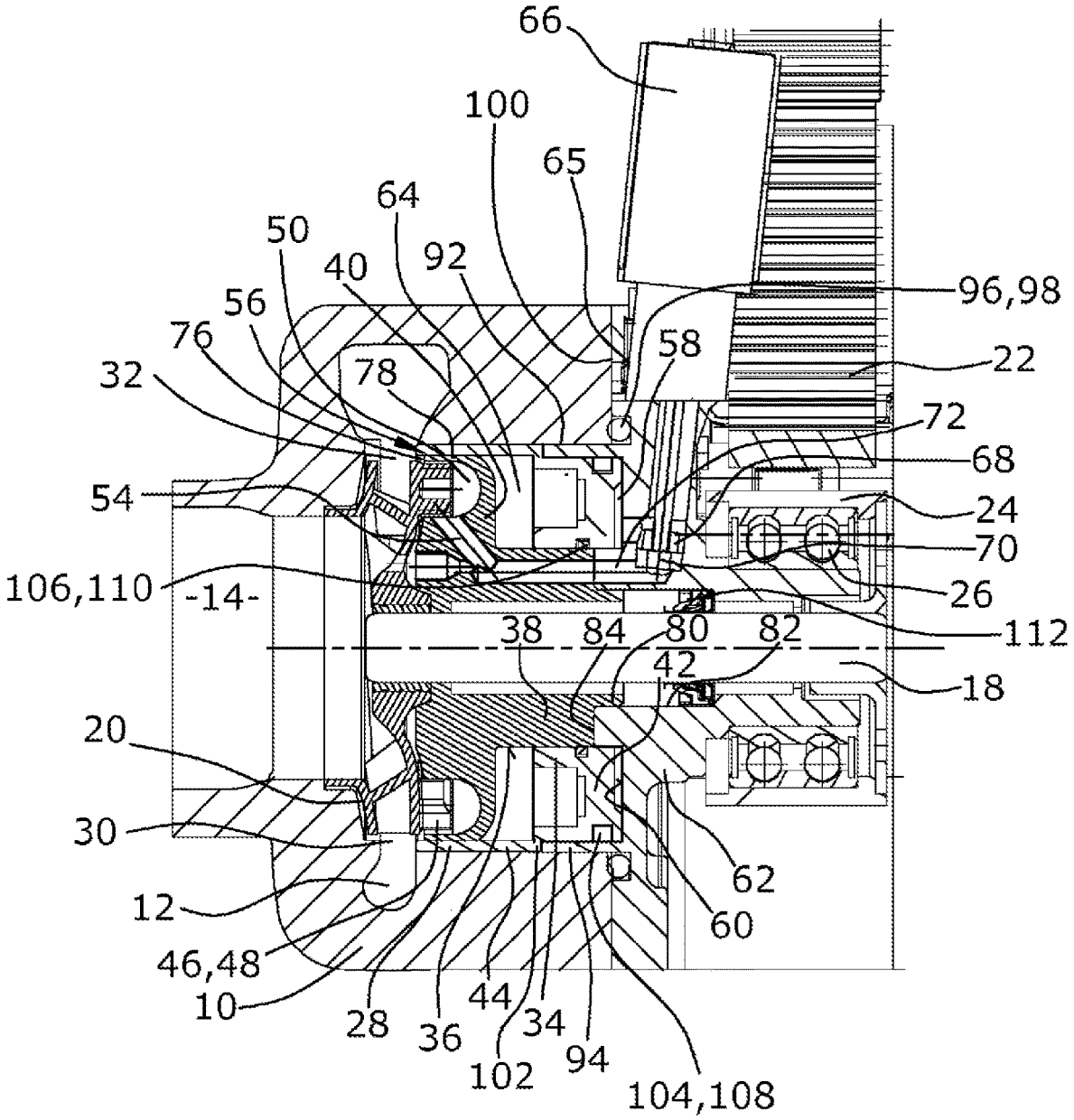
FIG. 2 shows a cross-sectional side view of the coolant pump according to the present invention rotated with respect to FIG. 1.

The required overall axial length is considerably reduced due to the fact that the coolant pump impeller is integrally formed with the side channel pump impeller and the side channel is formed in a first housing part on which the control slide is slidingly guided. Assembly steps for fastening the impeller to the shaft are also omitted. The manufacture of a component is also omitted. The first housing part assumes both the function as flow housing and support for the slide so that short delivery ducts can be provided.

In an embodiment of the present invention, the blades of the side channel pump impeller can, for example, be provided on a rear side of the coolant pump impeller configured as a radial pump impeller and can, for example, be arranged axially opposite to a side channel. The purely axial alignment of the side channel relative to the blades reduces the required radial installation space since no radially external overflow duct is required. A maximum pressure with respect to the existing installation space can accordingly be generated.

In an embodiment of the present invention, a radially outer boundary wall of the side channel can, for example, extend axially towards the coolant pump impeller, radially surrounds the side channel pump impeller, and is surrounded by a radially outer circumferential wall of the control slide. This wall accordingly fills the gap between the slide and the rotating side channel pump impeller and thus between the pressure-generating coolant flow and the delivered flow of the main pump. This wall can also be used as a guide for the control slide.

It is advantageous when the control slide is slidingly guided on an outer surface of an annular axially extending projection of the first housing part. This projection is accordingly formed in the radially inner area of the first housing part and allows for the internal support of the control slide on the outer surface which can advantageously be machined. This internal support of the control valve simplifies the installation into an accommodation opening of a cylinder crankcase whose inner surfaces need not be machined. Such an inner guide also allows for a very precise axial movement without any tilting or tipping of the control slide since there is always a sufficiently long guide surface despite the small installation space used.

In an embodiment of the present invention, the first pressure chamber can, for example, be formed on the axial side of the control slide facing away from the coolant pump impeller, and the first housing part can, for example, delimit a second pressure chamber towards a first axial side and the control slide delimits it towards the opposite axial side. The adjustment of the control slide can accordingly be completely performed via hydraulic forces which are merely supplied to the corresponding pressure chambers. Additional ring chambers or piston chambers need not be provided. Due to the delimitation via the first housing part, the fluidic connection to the pressure chambers can be provided by a simple bore in this housing part so that additional lines are not required.

In an embodiment of the present invention, the annular projection of the first housing part can, for example, delimit the two pressure chambers radially inwards. Additional seals in this area are therefore not required. A smooth gap-free sliding surface is also produced.

In an embodiment of the present invention, the pressure duct can, for example, extend through the annular projection of the first housing part so that no further lines must here be installed, while the first pressure chamber can also be directly fluidically connected to the side channel of the pump via the bores in the housing.

The pressure duct advantageously extends from the outlet of the side channel pump through the first housing part and a second housing part into the first pressure chamber, wherein the throughflow cross-section governed by the valve is formed in the second housing part. Besides the complete configuration of the connecting and pressure ducts for the purpose of operating the control slide, the control valve can also be arranged in the housing so that additional connections to the valve are here also omitted.

In an embodiment of the present invention, the annular projection of the first housing part can, for example, comprise a shoulder at its axial end from which the annular projection, with a reduced diameter, further axially extends into a corresponding accommodation opening of the second housing part to which the first housing part is fastened. Via the inner projection, a direct centering of the two housing parts with respect to each other is accordingly provided, thereby improving the accommodation and the guiding of the control slide. The latter can be manufactured with small tolerances so that a strong tightness along the slide with a good two-sided guiding is attainable.

A particularly simple and releasable fastening is provided when the first housing part is fastened to the second housing part via screws.

In an embodiment of the present invention, a connecting duct can, for example, be formed in the first housing part, the connecting duct extending from the side channel through the first housing part into the second pressure chamber. The connecting duct can be provided by a short bore or be directly produced during the casting process. Any additional lines are omitted and assembly is accordingly facilitated.

A coolant pump for an internal combustion engine is thus provided wherein a considerably reduced axial installation space is required due to the axial arrangement of the individual components with respect to each other. The pump is easy to install since additional lines are omitted and fewer components must be used. The pump offers a high reliability since the slide is reliably guided and supported. The coolant pump according to the present invention is accordingly easy and inexpensive to manufacture and assemble.

An exemplary embodiment of the coolant pump according to the present invention for an internal combustion engine is described below under reference to the drawings.

The coolant pump according to the present invention is composed of an outer housing 10 in which a spiral delivery duct 12 is formed into which a coolant is sucked via an axial pump inlet 14 that is also formed in the outer housing 10, which coolant is delivered via the delivery duct 12 to a tangential pump outlet 16 formed in the outer housing 10 and into a cooling circuit of the internal combustion engine. The outer housing 10 can in particular be provided by a cylinder crankcase which comprises a recess for accommodating the remaining coolant pump.

For this purpose, radially inside the delivery duct 12, a coolant pump impeller 20 is fastened to a drive shaft 18, which coolant pump impeller 20 is configured as a radial pump wheel the rotation of which effects the delivery of the coolant in the delivery duct 12.

The coolant pump impeller 20 is driven via a belt 22 which drives a belt pulley 24 that is fastened to the axial end of the drive shaft 18 opposite to the coolant pump impeller 20. The belt pulley 24 is supported via a two-row ball bearing 26. Providing a chain drive is also possible.

A control slide 28 is used to change the volume flow delivered by the coolant pump, the control slide 28 being adapted to be moved into an annular gap 30 between an outlet 32 of the coolant pump impeller 20 and the surrounding delivery duct 12 so as to control the available throughflow cross-section.

The control slide 28 is slidingly supported via an inner hollow cylindrical circumferential wall 34 on a mechanically processed outer surface 36 of an annular axially extending projection 38 of a first inner housing part 40. This inner hollow cylindrical circumferential wall 34 concentrically extends from a bottom 42 of the control slide 28 to a radially outer circumferential wall 44 which also extends in the same direction from the bottom 42 and is moved into the annular gap 30 for volume flow control.

According to the present invention, for actuating the control slide 28, on the axial side of the coolant pump impeller 20 opposite to the pump inlet 14, a side channel pump impeller 46 is integrally formed with the coolant pump impeller 20, which side channel pump impeller 46 is accordingly driven together with the coolant pump impeller 20. The side channel pump impeller 46 comprises blades 48 which are arranged axially opposite to a side channel 50 that is formed in the first inner housing part 40 from which, also in the radially inner area, the annular projection 38 for supporting the control slide 28 axially extends to the side facing away from the coolant pump impeller 20. An inlet 52 and an outlet 54 are formed in the first inner housing part 40 so that the side channel pump impeller 46 with the axially opposite side channel 50 forms a side channel pump 56 via which the pressure of the coolant is increased from the inlet 52 to the outlet 54 of the side channel pump 56.

The hydraulic pressure provided by the side channel pump 56 can either be supplied to a first pressure chamber 58 which is formed on the side of the control slide 28 facing away from the coolant pump impeller 20 between the bottom 42 of the control slide 28 and a connecting surface 60 of a second housing part 62, or to a second pressure chamber 64 which is arranged between the bottom 42 of the control slide 28 and the first inner housing part 40. For purposely supplying the pressure of the side channel pump 56 to these pressure chambers 58, 64, an accommodation portion 65 for a valve 66 is arranged in the second housing part 62, which valve 66 is configured as a 3/2-way magnetic valve and which comprises a connection to the pressure chambers 58, 64 so that, depending on the position of its closing body 68, a throughflow cross-section 70 of a pressure duct 72 is controlled.

The pressure duct 72 first extends from the outlet 54 of the side channel 50 of the side channel pump 56 into a radially inner area of the first inner housing part 40 forming the annular axially-extending projection 38, and from there axially into the second housing part 62 in which the controllable throughflow cross-section 70 of the pressure duct 72 is formed, the latter being adapted to be closed and opened by the closing body 68 of the magnetic valve 66. From this controllable throughflow cross-section 70, the pressure duct 72 further extends up to the first pressure chamber 58. The second pressure chamber 64 is connected to the side channel 50 via a connecting duct 74 which is formed in the first inner housing part 40, wherein the connecting duct 74 is configured by a bore which extends from an area of the inlet 52 of the side channel 50 directly into the second pressure chamber 64. A third flow connection (not shown in the drawings) of the magnetic valve 66 leads to the suction side of the coolant pump.

If the coolant pump is to deliver a maximum coolant flow during operation, the annular gap 30 at the outlet 32 of the coolant pump impeller 20 is completely opened by not applying current to the magnetic valve 66, whereby via a spring force, the closing body 68 is moved into its position in which it closes the throughflow cross-section 70 of the pressure duct 72. As a result, no pressure is built up by the coolant in the first pressure chamber 58, while the coolant present in the pressure chamber 58 can flow off to the pump inlet 14 of the coolant pump via the other flow connection (not shown in the drawings) of the magnetic valve 66 which is open in this state. In this state, the side channel pump 56 instead delivers against the closed throughflow cross-section 70 of the pressure duct 72, whereby an increased pressure builds up in the side channel 50, which also acts in the area of the inlet 52 of the side channel pump 56 and accordingly also builds up in the second pressure chamber 64 via the connecting duct 74. This increased pressure in the second pressure chamber 64 results in a pressure difference at the bottom 42 of the control slide 28, which leads to the control slide 28 being moved into its position in which the annular gap 30 is opened and thus maximum delivery of the coolant pump is provided. In the case of a failure of the power supply of the magnetic valve 66, the control slide 28 accordingly assumes the same position so that even in this emergency operating state a maximum delivery of the coolant pump is provided without a return spring or any other non-hydraulic power being necessary.

An excessive increase of the pressure in the second pressure chamber 64 is avoided, inter alia, due to a leakage via a gap 76 between a boundary wall 78 of the first housing part 40 delimiting the side channel 50 radially towards the outside, which boundary wall 50 directly surrounds the side channel pump impeller 46, and the radially outer circumferential wall 44 of the control slide 28 so that the coolant additionally delivered by the side channel pump 56 is also used for delivery into the cooling circuit. The coolant from the first pressure chamber 58 can flow out via a return duct (not shown in the drawings) which extends from the magnetic valve 66 through the second housing part 62 and then extends along the drive shaft 18 inside the first inner housing part 40 and via a bore in the coolant pump impeller 20 to the pump inlet 14 of the coolant pump.

If the engine control requires a reduced coolant flow to the cooling circuit, as is the case, for example, during the cold running phase, current is applied to the magnetic valve 66, whereby the closing body 68 opens the throughflow cross-section 70 of the pressure duct 72 and reduces and/or closes the throughflow cross-section between the first pressure chamber 58 and the (not illustrated) return duct. The pressure produced at the outlet 54 of the side channel pump 56 is also accordingly supplied to the first pressure chamber 58 via the pressure duct 72, while at the same time the pressure in the second pressure chamber 64 decreases since a reduced pressure occurs in the area of the inlet 52 due to the intake of the coolant. First, the coolant present in the second pressure chamber 64 is also extracted. In this state, a pressure difference opposite to that of the other position of the magnetic valve 66 is accordingly present at the bottom 42 of the control slide 28, which pressure difference results in the control slide 28 being moved into the annular gap 30 and thus the coolant flow in the cooling circuit being interrupted. In the case of an increased pressure buildup in the first pressure chamber 58, the pressure in the side channel 50 and in the second pressure chamber 64 also increases after a while, but this does not lead to a return movement since the leakage from the second pressure chamber 64 is larger than that from the first pressure chamber 58 and, for adjustment purposes, a frictional force must additionally be overcome. In this state, the pressure at the outlet 54 of the side channel 50 is also always higher than in the area of the connecting duct 74. The control slide 28 accordingly remains in the desired position without an excessive pressure increase.

If a controllable magnetic valve 66 is used, it is also possible to move the valve 66 into intermediate positions, whereby, for each position of the control slide 28, an equilibrium of forces is attainable so that a complete control of the throughflow cross-section of the annular gap 30 is allowed for.

The first inner housing part 40 is directly fastened to the second housing part 62 to provide the compact structure by the integral design of the coolant pump impeller 20 with the side channel pump impeller 46 and a tight connection of the duct sections of the pressure duct 72 or the return duct formed in the first inner housing part 40 and the second housing part 62 and for providing the small leakages via the control slide 28 and thus providing complete control. This is effected by the first inner housing part 40, which has an annular projection 80 that extends, with a reduced diameter, from the annular projection 38 further towards the end facing away from the coolant pump impeller 20, being pushed into a radially inner accommodation opening 82 of the second housing part 62 until the first inner housing part 40 with its shoulder 84 formed between the projections 38, 80 rests upon the connecting surface 60 of the second housing part 62. In this position, the first inner housing part 40 is fastened to the second housing part via screws 86. For this purpose, several through-going bores 88 are formed in the first inner housing part 40 and opposite threaded blind holes 90 are formed in the second housing part 62.

For fastening the two housing parts 40, 62 to the outer housing 10 and the resultant arrangement of the control slide 28 in the outer housing 10, the outer housing 10 comprises an opening 92 at its axial end opposite to the axial pump inlet 14, into which opening 92 an annular projection 94 of the second housing part 62 projects so that the annular projection 94 rests upon the inner wall of the opening 92. Radially outside of the annular projection, which can be provided as a hollow cylindrical projection, an axial groove 96 is formed in which a sealing ring 98 is arranged that is pressed to the outer housing 10 during fastening of the second housing part 62, wherein the connecting surface 60 of the second housing part 62 rests upon an outer wall 100 of the outer housing 10.

The annular projection 94 at the same time serves as a rear stopper 102 for the control slide 28 whose radially outer circumferential wall 44 continues with its end having a slightly increased diameter and facing the coolant pump impeller 20. At the inner circumference and at the outer circumference of the bottom 42, a respective radial groove 104, 106 is formed in each of which a piston ring 108, 110 is arranged via which the control slide 28 is slidingly supported and thus guided in a sealing manner in the radially inner area on the annular axially extending projection 38 of the first housing part 26 and in the radially outer area at an inner wall of the annular projection 94 of the second housing part 62 projecting into the opening 92 of the outer housing 10.

Thus, after the installation, merely the rear piece of the drive shaft 18 as well as the rear portion of the second housing part 62, in which the magnetic valve 66 is accommodated and onto which the two-row ball bearing 26 supporting the belt pulley 24 is pressed, project from the opening 92 of the outer housing 10. With a seal 112 as an intermediate layer, the drive shaft 18 extends centrally through the two housing parts 40, 62.

The described coolant pump has an extremely compact design but is easy and inexpensive to manufacture and assemble since a small number of parts are provided. Additional lines for a hydraulic connection of the side channel pump to the pressure chambers of the control slide can be omitted since the latter can be configured, over very short distances, as simple bores in the two inner housing parts. Due to the fact that the control slide is guided in the inner area on the housing part which also forms and radially delimits the side channel, the control slide can be guided along this boundary wall with a well-defined clearance and a resultant defined leakage. Due to the axially very short design attributable to the integrally formed impeller for the side channel pump and the coolant delivery pump proper, the latter is in particular suitable for being arranged directly in an opening of the crankcase.

It should be appreciated that the scope of protection of the main claim is not limited to the described exemplary embodiment but that various modifications which fall into the scope of protection are conceivable. Thus merely one pressure chamber could be used and a return movement of the control slide could be effected via a spring. Reference should also be had to the appended claims.

What is claimed is:

1. A coolant pump for an internal combustion engine, the coolant pump comprising:

a delivery duct;

a drive shaft;

a coolant pump impeller arranged on the drive shaft so as to rotate jointly therewith, the coolant pump impeller being configured to covey a coolant into the delivery duct which surrounds the coolant pump impeller;

a control slide which is configured to be adjustable so as to control a throughflow cross-section of an annular gap arranged between an outlet of the coolant pump impeller and the delivery duct, the control slide comprising a first pressure chamber;

a side channel pump comprising a side channel pump impeller arranged on the drive shaft so as to rotate jointly therewith, and a side channel which is configured so that a pressure can be generated by a rotation of the side channel pump impeller, the side channel comprising an outlet;

a pressure duct comprising a throughflow cross-section, the pressure duct being configured to fluidically connect the outlet of the side channel to the first pressure chamber of the control slide;

a valve configured to open and to close the throughflow cross-section of the pressure duct; and a first housing part configured to have the side channel be formed therein and to have the control slide be slidingly guided thereon, wherein, the coolant pump impeller is integrally formed with the side channel pump impeller.

2. The coolant pump as recited in claim 1, wherein, the side channel pump impeller comprises blades which are formed on a rear side of the coolant pump impeller, the coolant pump impeller is formed as a radial pump impeller, and the blades are arranged axially opposite to the side channel.

3. The coolant pump as recited in claim 2, wherein, the control slide further comprises an outer circumferential wall, and the side channel further comprises a radially outer boundary wall which extends axially in a direction of the coolant pump impeller, radially surrounds the side channel pump impeller, and is radially surrounded by the outer circumferential wall of the control slide.

4. The coolant pump as recited in claim 1, wherein, the first housing part comprises an axially extending annular projection which comprises an outer surface, and the control slide is further configured to be slidingly guided on the outer surface of the axially extending annular projection of the first housing part.

5. The coolant pump as recited in claim 4, further comprising:

a second pressure chamber, wherein, the first pressure chamber is formed on an axial side of the control slide which faces away from the coolant pump impeller, the first housing part is further configured to delimit the second pressure chamber towards a first axial side, and the control slide is further configured to delimit the second pressure chamber towards a second axial side which is opposite to the first axial side.

6. The coolant pump as recited in claim 5, wherein the axially extending annular projection of the first housing part is configured to delimit the first pressure chamber and the second pressure chamber radially inwardly.

7. The coolant pump as recited in claim 5, further comprising:

a connecting duct arranged in the first housing part, the connecting duct being configured to extend from the side channel through the first housing part into the second pressure chamber.

8. The coolant pump as recited in claim 4, wherein the pressure duct is further configured to extend through the axially extending annular projection of the first housing part.

9. The coolant pump as recited in claim 4, further comprising:

a second housing part, wherein, the pressure duct is further configured to extend from the outlet of the side channel of the side channel pump through the first housing part and the second housing part into the first pressure chamber, and the throughflow cross section controlled by the valve is formed in the second housing part.

10. The coolant pump as recited in claim 9, wherein, the second housing part comprises an accommodation opening, the second housing part is fastened to the first housing part, and the axially extending annular projection of the first housing part comprises a shoulder at an axial end from which an annular projection which comprises a reduced diameter is configured to extend further axially into the accommodation opening of the second housing part.

11. The coolant pump as recited in claim 10, further comprising screws configured to fasten the first housing part to the second housing part.

* * * * *